United States Patent [19]

Baitcher

[11] 4,319,098

[45] Mar. 9, 1982

[54] LOUDSPEAKER HAVING A UNITARY MECHANICAL-ACOUSTIC DIAPHRAGM TERMINATION

[75] Inventor: Neal L. Baitcher, Hoffman Estates, Ill.

[73] Assignee: Motorola, Inc., Schaumburg, Ill.

[21] Appl. No.: 145,157

[22] Filed: Apr. 30, 1980

[51] Int. Cl.[3] ..... H04R 7/26

[52] U.S. Cl. ..... 179/180; 179/115.5 ES; 181/166; 181/171

[58] Field of Search ..... 179/180, 181 R, 115.5 ES, 179/110 A, 115 R; 181/166, 172, 171, 167

[56] References Cited

U.S. PATENT DOCUMENTS

| | | | |
|---|---|---|---|
| 675,331 | 5/1901 | Johnson | 179/180 X |
| 1,808,512 | 6/1931 | Shapiro | 181/166 |
| 2,034,882 | 3/1936 | Scribner | 179/110 A X |
| 2,863,520 | 12/1958 | Manley et al. | 181/172 |
| 3,603,427 | 9/1971 | Sotome | 181/166 |
| 3,645,356 | 2/1972 | Sotome | 181/172 |
| 4,190,746 | 2/1980 | Harwood et al. | 179/115.5 R |

FOREIGN PATENT DOCUMENTS

| | | | |
|---|---|---|---|
| 1493296 | 11/1977 | United Kingdom | 179/115.5 ES |

*Primary Examiner*—Thomas W. Brown

*Attorney, Agent, or Firm*—Mark P. Kahler; Edward M. Roney; James W. Gillman

[57] ABSTRACT

The periphery of the diaphragm of a loudspeaker is mechanically connected to a diaphragm support or basket by a layer of acoustic dampening-adhesive material. The layer of acoustic dampening-adhesive material covers a sufficient portion of the surfaces of the diaphragm to dampen standing waves which would otherwise reflect from the periphery of the diaphragm. Thus, a unitary diaphragm mechanical termination-acoustic termination structure is formed.

4 Claims, 5 Drawing Figures

LOUDSPEAKER HAVING A UNITARY MECHANICAL-ACOUSTIC DIAPHRAGM TERMINATION

BACKGROUND OF THE INVENTION

This invention relates to loudspeakers, and more particularly, to acoustic dampening of loudspeaker diaphragms and mechanical termination thereof.

DESCRIPTION OF THE PRIOR ART

Conventional loudspeakers typically include an electroacoustic transducer driving element mechanically connected to the center of a diaphragm. The periphery of the diaphragm is often mechanically connected by cement to a support or basket which forms the housing for the loudspeaker as depicted in the prior art electrodynamic loudspeaker illustrated in FIG. 1. In such conventional loudspeakers, two types of terminations of the diaphragm are typically desired, that is, a mechanical termination (connection) of the diaphragm periphery to the surrounding support and an acoustic termination of the diaphragm which prevents standing waves, especially those occurring at relatively high audio frequencies, from reflecting back from the periphery of the diaphragm toward the center thereof. The acoustic termination of the diaphragm also prevents the speaker housing from being undesirably mechanically excited by acoustic vibration of the diaphragm.

As shown in the prior art example of FIG. 1, the mechanical termination and the acoustic termination of the diaphragm are conventionally accomplished by two distinct structures. More specifically, the periphery of the loudspeaker diaphragm is typically cemented to the surrounding support or basket structure to form the mechanical termination of the diaphragm or at least a part thereof. An adhesive cement is situated between the support and diaphragm periphery to accomplish this purpose. Additional structural integrity is provided to this mechanical termination typically by coating the outermost portion of the diaphragm periphery with an adhesive cement and placing a gasket thereon to better hold the diaphragm in place in the manner illustrated in FIG. 1.

Separate and apart from the above-discussed diaphragm mechanical termination, the diaphragm is conventionally acoustically terminated near the periphery but separate therefrom by applying a layer of suitable acoustic dampening material near the periphery of the speaker diaphragm where rolls or grooves are often employed to control, in part, the compliance of the speaker as in FIG. 1. The acoustic dampening material applied near the diaphragm periphery where rolls may be present prevents generation of standing waves which would otherwise travel from the center of the diaphragm to the periphery and back. If such standing waves were allowed to occur, especially those at relatively high frequencies, many irregularities in the frequency response of the resultant loudspeaker would occur. It must be stressed that in the conventional loudspeaker the acoustic dampening material employed to achieve acoustic termination of the diaphragm periphery is a different structure and physically separated from the cement adhesive and gasket conventionally employed to achieve mechanical termination of the speaker diaphragm periphery. Thus, at least a two-step operation and at least two distinct structures are conventionally required to achieve both mechanical termination of the speaker diaphragm periphery and acoustically dampened termination of the speaker diaphragm.

The present invention concerns employing a single, unitary adhesive structure to achieve both mechanical termination and acoustic termination of a loudspeaker diaphragm. At least one step in loudspeaker fabrication is thus eliminated and concurrently, increased cost effectiveness in loudspeaker fabrication is achieved.

Accordingly, it is one object of the present invention to provide a loudspeaker including a unitary speaker diaphragm mechanical termination-acoustic termination, that is, a layer of acoustic dampening-adhesive material so situated as to accomplish both mechanical and acoustic termination of the loudspeaker diaphragm.

Another object of the invention is to provide a loudspeaker exhibiting a relatively uniform frequency response.

These and other objects of the invention will become apparent to those skilled in the art upon consideration of the following description of the invention.

BRIEF SUMMARY OF THE INVENTION

The present invention is directed to providing a loudspeaker having a unitary mechanical termination-acoustic termination of the loudspeaker diaphragm.

In accordance with one embodiment of the invention, a loudspeaker includes a diaphragm of selected material having upper and lower surfaces as well as a periphery. The loudspeaker further includes a driving element such as a piezoelectric or electrodynamic transducer for vibrating the diaphragm in accordance with a varying electrical signal applied to the driving element. The driving element is operatively attached to the diaphragm. A support or basket is provided for mechanically supporting the diaphragm around the periphery thereof. The loudspeaker includes a layer of acoustic dampening-adhesive material situated to mechanically connect the support to the periphery of the diaphragm. The acoustic dampening-adhesive material is situated to cover a sufficient portion of at least one of the upper and lower surfaces of the diaphragm to dampen standing waves which would otherwise reflect from the periphery of the diaphragm and to substantially dampen standing waves which would otherwise mechanically excite the speaker support.

The features of the present invention believed to be novel are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE PREFERRED EMBODIMENT

Figure 1:
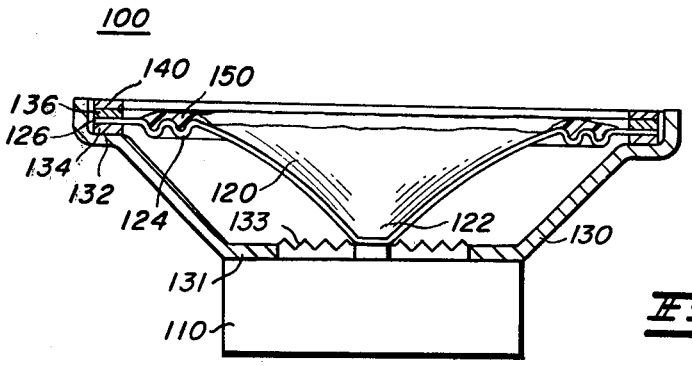
PRIOR ART Fig. 1
FIG. 1 shows a cross-section of a conventional loudspeaker having separate acoustic and mechanical diaphragm terminations.

FIG. 1 illustrates a conventional loudspeaker 100 of the type discussed briefly above in the Description of the Prior Art. Loudspeaker 100 includes an electroacoustic driving element 110 such as an electrodynamic transducer which vibrates when excited by a varying electrical signal applied to element 110. A diaphragm 120, typically having a cone-shaped geometry, includes an apex 122 which is conventionally mechanically coupled to driving element 110 to receive mechanical vibrations therefrom. Rolls or grooves 124 are situated proximate to the periphery 126 of diaphragm 120. Loudspeaker 100 includes asupport 130 which is often shaped in the form of a cup or basket. Support 130 includes a lower flange 131 and an upper flange 132. Diaphragm apex 122 is connected to flange 131 via a support member 133, typically, corrugated, and thus diaphragm 120 is, in part, supported. A layer of cement 134 is situated on flange 132 as shown. The periphery 126 of diaphragm 120 is situated in contact with cement layer 134 such that cement layer 134 mechanically connects diaphragm periphery 126 to support 130. A cement layer 136 is situated on and above periphery 126 of diaphragm 120 such that a gasket 140 situated on cement layer 136 strengthens the mechanical connection between diaphragm periphery 126 and support 130. A combination of elements, namely flange 132, cement layer 134, cement layer 136 and gasket 140 cooperate to form the mechanical termination of diaphragm 120. A layer of compliant acoustic dampening material 150 is situated on and covering rolls 124 to form the acoustic termination of diaphragm 120 which dampens standing waves travelling on diaphragm 120. It is again noted that the prior art loudspeaker 100 of FIG. 1 exhibits physically separate mechanical and acoustic terminations formed by employing various cements and adhesives situated at different and structurally distinct locations on diaphragm 120. The geometry of the above-mentioned elements of speaker 100 are generally circular although other geometries, such as an ovular geometry, could be employed.

Figure 2A:
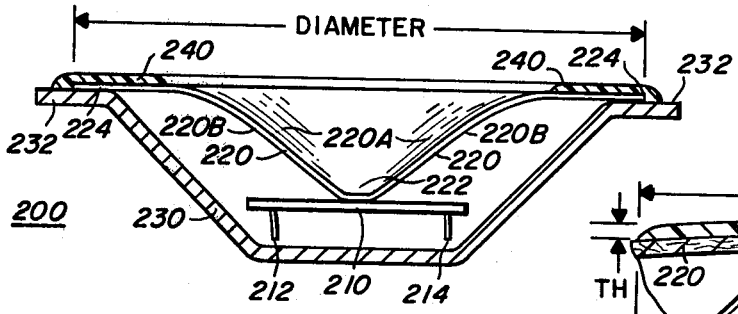
FIG. 2A shows a cross-section of one embodiment of the loudspeaker of the present invention having a unitary mechanical-acoustic diaphragm termination.

FIG. 2A shows a cross-section of one embodiment of the loudspeaker of the present invention as loudspeaker 200. Loudspeaker 200 includes a driving element 210, that is, an electroacoustic transducer such as a piezoelectric or electrodynamic transducer, for example. Electroacoustic transducer 210 vibrates in accordance with a varying electrical signal applied thereto via electrically conductive leads 212 and 214 which are operatively connected to transducer-driving element 210. Loudspeaker 200 includes a diaphragm 220 having a substantially conical geometry with an apex or center 222. Of course, other geometries for diaphragm 220 may be employed consistent with practice in the art. Diaphragm center 222 is mechanically connected to driving element 210 such that mechanical vibrations are transmitted to diaphragm 220 when driving element 210 is excited by a varying electrical signal. Diaphragm 220 includes an upper surface 220A and a lower surface 220B. Diaphragm 220 further includes a perphery 224 which is defined to be the outermost portion of diaphragm 220 situated away from center 222.

Loudspeaker 200 further includes a support member 230 which may be cup-shaped or basket-shaped as shown in FIG. 2A by way of example. Support member 230 is employed to physically support the above-described driving element 210-diaphragm 220 structure and to provide a housing for the same. Support member 230 includes a flange 232 at the rim of support member 230. Periphery 224 of diaphragm 220 is situated on flange 232 with lower diaphragm surface 220B being situated in contact with flange 232. Diaphragm 220 and driving element 210 are thus physically supported by support member 230 in the manner shown.

A layer of acoustic dampening-adhesive material 240 is situated covering a sufficient portion of flange 232 and diaphragm periphery 224 to mechanically connect each to the other. Layer 240 is further situated on and extending over a sufficient portion of upper diaphragm surface 220A to dampen standing waves on diaphragm 220 which would otherwise reflect from diaphragm periphery 224 back toward apex 222. Thus, it is seen that a single structure, namely acoustic dampening-adhesive material layer 240 provides both the mechanical termination of diaphragm 220 and the acoustic termination of diaphragm 220.

One type of material which may be employed as acoustic dampening-adhesive material layer 240 is polyvinylchloride copolymer rubber, for example, Adhesive VS6004, manufactured by C. P. Moyen Company, Skokie, Ill. Other acoustic dampening-adhesive materials may, of course, be employed for layer 240 providing such materials possess sufficient adhesive properties to mechanically connect diaphragm 220 to support 230 and sufficient acoustic dampening properties to substantially dampen acoustic standing waves travelling through diaphragm 220 when situated thereon.

Figure 2B:
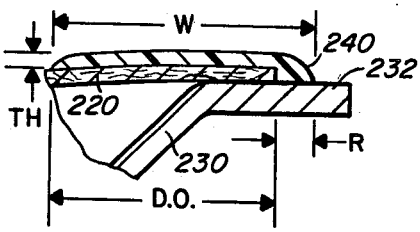
FIG. 2B is a fragmentary closeup view of the mechanical-acoustic termination portion of FIG. 2A.

Acoustic dampening-adhesive material layer 240 exhibits a preselected total width (W) and a preselected thickness (TH), the meanings of these terms being clearly graphically depicted in FIG. 2B. By way of example, assuming speaker 200 includes a diaphragm 220 substantially conically shaped and having a diameter equal to 2.465 inches, the thickness (TH) of layer 240 is conveniently 0.01 inches and the total width (W) of layer 240 is preferably 0.175 inches. A portion of layer 240 overlaps flange 232. The portion of the total width (W) of layer 240 which overlaps or contacts flange 232 is designated "runover" (R). "Runover" is conveniently equal to approximately 0.05 inches. A portion of the total width (W) of layer 240 overlaps a portion of diaphragm 220 and this overlap is designated "diaphragm overlap" (D.O.). Diaphragm overlap is conveniently equal to approximately 0.125 inches. It must be stressed that the above given specific parameter values are given only by way of example. More specifically, the width (W) of layer 240, the thickness (TH) of layer 240, flange "runover" and "diaphragm overlap" will, of course, vary with the particular diaphragm geometry, diaphragm diameter, loudspeaker frequency range and basket geometry selected for a particular loudspeaker, whether it be a tweeter speaker, midrange speaker or otherwise. In general, however, the "runover" and thickness (TH) of layer 240 must be sufficiently large to contact flange 232 of support 230 and form a mechanical connection having structural integrity between diaphragm 220 and flange 232. More simply speaking, the "runover" and thickness (TH) of layer 240 must be sufficiently large to establish the mechanical termination of diaphragm 220. Additionally, although the cone geometry and diameter, the frequency range of the loudspeaker and the geometry of support member 230 may vary, it is important that the "diaphragm overlap" and thickness (TH) of layer 240 is sufficiently large to dampen standing waves on diaphragm 220 which would otherwise reflect back from diaphragm periphery 224 toward apex 222 and sufficiently large to prevent acoustic waves travelling through diaphragm 220 from mechanically exciting support-housing 230. More simply stated, the "diaphragm overlap" and thickness (TH) of layer 240 must be sufficiently large to form an acoustic termination for diaphragm 220.

Figure 3A:
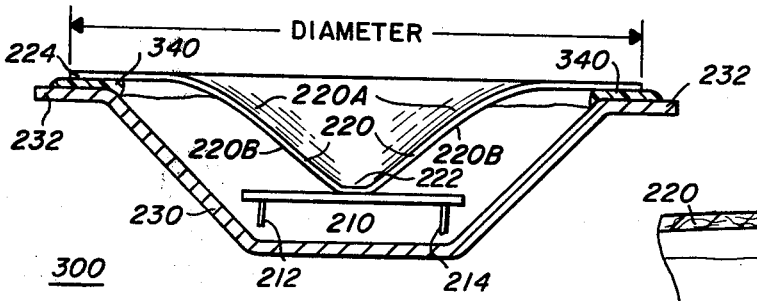
FIG. 3A shows another embodiment of the loudspeaker of the present invention having a unitary mechanical-acoustic diaphragm termination.
Figure 3B:
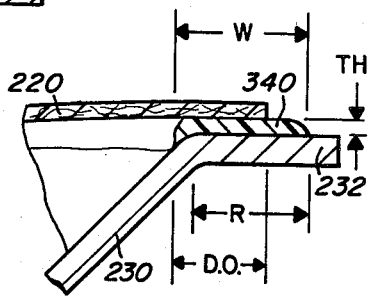
FIG. 3B is a fragmentary closeup view of the mechanical-acoustic termination portion of FIG. 3A.

FIG. 3A shows a cross-section of another embodiment of the loudspeaker of the present invention as loudspeaker 300. Loudspeaker 300 is substantially similar to loudspeaker 200 described above under the discussion of FIGS. 2A and 2B except for the following modifications. Whereas loudspeaker 200 includes a layer of acoustic dampening-adhesive material 240 situated substantially on upper surface 220A of diaphragm 220, loudspeaker 300 of FIG. 3 includes a layer of acoustic dampening-adhesive material 340 situated on lower surface 220B of diaphragm 220. More specifically, layer 340 (see FIG. 3B for closeup view) is situated between diaphragm 220 and flange 232 in such a manner as to meet the width, thickness, "runover" and "diaphragm overlap" criteria set forth above in the discussion of FIGS. 2A and 2B. (To maintain consistency of nomenclature, it is to be noted that in this embodiment, "runover" equals the width of the portion of acoustic dampening-adhesive layer 340 which overlaps (that is, contacts) flange 232 as shown). Thus, diaphragm 220 of loudspeaker 300 is both mechanically terminated and acoustically terminated in a single, unitary structure, namely acoustic dampening-adhesive material layer 340.

The foregoing describes a loudspeaker having a unitary speaker diaphragm mechanical termination-acoustic termination. The loudspeaker of the present invention desirably provides a relatively uniform frequency response.

While only certain preferred features of the invention have been shown by way of illustration, many modifications and changes will occur to those skilled in the art. For example, the layer of acoustic dampening-adhesive material may be situated on both upper diaphragm surface 220A and lower diaphragm surface 220B as long as the above set forth diaphragm mechanical termination and diaphragm acoustic termination criteria are met. It is, therefore, to be understood that the present claims are intended to cover all such modifications and changes as fall within the true spirit of the invention.

I claim:

1. A loudspeaker comprising:

a diaphragm of selected material having upper and lower surfaces and including a periphery;

driving means operatively attached to said diaphragm for vibrating said diaphragm in accordance with a varying electrical signal applied to said driving means;

support means for supporting said driving means and said diaphragm around the periphery of said diaphragm, said support means including a flange, the lower surface of said diaphragm at said diaphragm periphery being situated in contact with said flange, and a layer of acoustic dampening-adhesive material situated covering a sufficient portion of said flange and said diaphragm periphery to form a mechanical connection exhibiting structural integrity between said flange and said diaphragm, said dampening-adhesive material situated covering a sufficient portion of the upper surface of said diaphragm to substantially dampen standing waves otherwise reflecting from the periphery of said diaphragm and to substantially dampen standing waves otherwise mechanically exciting said support means.

2. The loudspeaker of claim 1 wherein said driving means comprises a piezoelectric transducer.

3. The loudspeaker of claim 1 wherein said acoustic dampening-adhesive material is comprised of polyvinylchloride copolymer rubber.

4. The loudspeaker of claim 2 wherein said acoustic dampening-adhesive material is comprised of polyvinylchloride copolymer rubber.

* * * * *